US009567769B2

(12) United States Patent
Zimmer et al.

(10) Patent No.: US 9,567,769 B2
(45) Date of Patent: Feb. 14, 2017

(54) DOOR STRUCTURE HAVING A LOCKING ELEMENT THAT INHIBITS THE DOOR RELEASE

(71) Applicant: Dr. Ing. h.c. F. Porsche Aktiengesellschaft, Stuttgart (DE)

(72) Inventors: Jens Zimmer, Wiernsheim-Iptingen (DE); Rolf Goetz, Stuttgart (DE); Lars Schulz, Schoeneiche (DE); Marcos Garcia Garcia, Stuttgart (DE); Lutz Trender, Bad Liebenzell (DE)

(73) Assignee: DR. ING. H.C.F. PORSCHE AKTIENGESELLSCHAFT, Stuttgart (DE)

( * ) Notice: Subject to any disclaimer, the term of this patent is extended or adjusted under 35 U.S.C. 154(b) by 111 days.

(21) Appl. No.: 14/261,004

(22) Filed: Apr. 24, 2014

(65) Prior Publication Data

US 2014/0319857 A1 Oct. 30, 2014

(30) Foreign Application Priority Data

Apr. 24, 2013 (DE) ..... 10 2013 104 144

(51) Int. Cl.
*E05B 3/00* (2006.01)
*E05B 15/02* (2006.01)
(Continued)

(52) U.S. Cl.
CPC ..... *E05B 15/022* (2013.01); *E05B 77/04* (2013.01); *E05B 79/20* (2013.01); *E05B 77/02* (2013.01); *Y10S 292/65* (2013.01); *Y10T 292/702* (2015.04)

(58) Field of Classification Search
CPC ..... E05B 15/022; E05B 77/02; E05B 77/04; Y10S 292/65
(Continued)

(56) References Cited

U.S. PATENT DOCUMENTS 4,848,813 A * 7/1989 Fildan ..... E05C 1/163 292/167
5,492,379 A * 2/1996 Staser ..... E05B 79/12 292/336.3
(Continued)

FOREIGN PATENT DOCUMENTS

DE 102008021158 A1 * 10/2009 ..... B60R 21/0428
DE 102012000452 A1 * 9/2012 ..... E05B 77/04
(Continued)

OTHER PUBLICATIONS http://www.boronextrication.com/2010/1/12/2010-chevrolet-malibu-high-strength-steel/ (Jan. 12, 2010).
(Continued)

*Primary Examiner* — Carlos Lugo
(74) *Attorney, Agent, or Firm* — Gerald E. Hespos; Michael J. Porco; Matthew T. Hespos

(57) ABSTRACT

A door structure for vehicles has a door outer lining, a door inner lining and a locking/closing mechanism with actuating elements on the outer side and optionally on the inner side of the door. The locking/closing mechanism is connected to the door release via at least one transmission element (8) between the door outer lining and the door inner lining. A locking element (1) between the door outer lining and the door inner lining acts on the transmission element (8) and inhibits the door release in the event of a side impact, The locking element (1) inhibits the operation of the transmission element (8) by blocking it as a result of pivoting of the locking element (1) in the event of a relative movement of the door outer lining in the direction of the door inner lining.

4 Claims, 3 Drawing Sheets

(51) Int. Cl.

| | |
|---|---|
| ***E05B 77/04*** | (2014.01) |
| ***E05B 79/20*** | (2014.01) |
| *E05B 65/10* | (2006.01) |
| *E05B 77/02* | (2014.01) |

(58) Field of Classification Search
USPC ..... 292/1, 336.3; 296/187.12
See application file for complete search history.

(56) References Cited

U.S. PATENT DOCUMENTS

| | | | | |
|---|---|---|---|---|
| 5,755,484 | A * | 5/1998 | Chou | B60J 5/0447 248/68.1 |
| 6,065,797 | A * | 5/2000 | Shirasaka | E05B 77/12 292/DIG. 65 |
| 7,014,249 | B2 * | 3/2006 | Karuppaswamy | B60J 5/0451 296/146.6 |
| 7,156,448 | B2 * | 1/2007 | Armbruster | B60J 5/0431 296/146.6 |
| 7,648,192 | B2 * | 1/2010 | Herline | E05B 77/04 292/92 |
| 7,766,401 | B2 * | 8/2010 | Costigan | E05B 79/12 292/336.3 |
| 8,079,631 | B2 * | 12/2011 | Higgins | E05B 77/04 292/259 A |
| 8,235,451 | B2 * | 8/2012 | Jordan | E05B 77/02 292/259 A |
| 8,360,486 | B2 * | 1/2013 | Gschweng | E05B 17/0062 292/336.3 |
| 8,465,064 | B2 * | 6/2013 | Ghannam | E05B 77/04 292/216 |
| 8,701,817 | B2 * | 4/2014 | Schoen | E05B 77/04 180/281 |
| 2007/0013206 | A1 * | 1/2007 | Huttsell | B60J 5/0425 296/146.6 |
| 2007/0069525 | A1 * | 3/2007 | Ghannam | E05B 77/04 292/216 |
| 2011/0258935 | A1 * | 10/2011 | Heller | B60J 5/0451 49/502 |
| 2011/0290577 | A1 | 12/2011 | Abidi | |

FOREIGN PATENT DOCUMENTS

| | | | | |
|---|---|---|---|---|
| DE | 102012010997 | A1 * | 12/2012 | E05B 77/04 |
| DE | 102012000451 | A1 * | 7/2013 | E05B 77/04 |
| DE | 102013104143 | A1 * | 10/2014 | E05B 79/20 |
| DE | 102013104145 | A1 * | 10/2014 | E05B 77/04 |
| GB | 2361675 | * | 10/2001 | E05B 77/04 |
| GB | 2462116 | A | 1/2010 | |
| JP | 2002213131 | A | 7/2002 | |
| KR | 100811714 | | 3/2008 | |

OTHER PUBLICATIONS

Korean Office Action.
French Search Report Dated Feb. 22, 2016.

* cited by examiner

DOOR STRUCTURE HAVING A LOCKING ELEMENT THAT INHIBITS THE DOOR RELEASE

CROSS REFERENCE TO RELATED APPLICATION

This application claims priority under 35 USC 119 to German Patent Appl. No. 10 2013 104 144.2 filed on Apr. 24, 2013, the entire disclosure of which is incorporated herein by reference.

BACKGROUND

1. Field of the Invention

The invention relates to a door structure for vehicles, having a door outer lining and a door inner lining. The door structure has a locking/closing mechanism with actuating elements on the outer side and optionally on the inner side of the door. The locking/closing mechanism is connected to the door release via at least one transmission element.

2. Description of the Related Art

Studies of the consequences of traffic accidents and tests carried out on vehicles that have been involved in an accident have shown that the doors of the vehicle should remain closed in the event of a side impact or a side collision in spite of considerable deformation under certain circumstances. Doors that open automatically in the event of a crash involve, inter alia, the risk that occupants may be thrown out before the kinetic energies that occur in the vehicle involved in an accident have been able to dissipate. The tests and studies have shown that consequences generally are less serious if persons remain within the vehicle cell.

Closing devices for doors in vehicles generally comprise a locking/closing mechanism that can be released for opening the door via a transmission element, for example a Bowden cable or a linkage, arranged between the door outer lining and the door inner lining. The transmission element interacts with actuating elements arranged on the outer side and optionally on the inner side of the door. To inhibit automatic opening of the door in the event of a crash, DE 10 2008 021 158 A1 discloses a further transmission means in addition to the transmission element provided for unlocking the door. The further transmission means renders the actual transmission element inoperable, for example by blocking, in the event of a crash. This mechanism disadvantageously has a relatively complex structure that is costly and heavy. In the case of correspondingly severe deformation of the door structure, satisfactory operation is no longer ensured on account of the complex structure of this mechanism.

DE 10 2005 049 144 A1 and EP 1 937 920 B1 disclose mechanisms that also are intended to inhibit undesired opening of the door in the event of a crash. These mechanisms operate with mass blocks that are intended to block the transmission element, for example a Bowden cable, by positional displacement as a result of its inertia. Both solutions known from the prior art propose integrating these mass blocks in the door handle itself and result in a very complex and expensive door handle construction.

The invention is based on the object of achieving absolute operational reliability with a construction that is a simple as possible and above all low weight.

SUMMARY OF THE INVENTION

The invention has a locking element arranged in a manner acting on a transmission element extending between the door inner lining and the door outer lining, such as acting on a Bowden cable, via which a locking/closing mechanism is actuable. The locking element inhibits operation of the transmission element by blocking actuation at the door lock in the event of a relative movement of the door outer lining in the direction of the door inner lining, for example as a result of the deformation of the door outer lining in the event of a crash.

The locking element preferably has a blocking element that engages partially around the transmission element and is pivotably articulated on a guide part such that, in the event of a crash—in particular in the case of a side impact in the region of a door—the blocking element is pivotable radially with respect to the transmission element until the transmission element is jammed in a blocked manner. The blocking element can be clipped firmly to the guide part in a pivotable manner. However, the blocking element alternatively may be fastened via a film hinge, for example when the locking element is made from a suitable plastics material.

The blocking element may have at least one blocking edge projecting toward the transmission element. The blocking edge achieves absolutely secure jamming of the transmission element in the event of a crash, in that the transmission element—generally a Bowden cable—is blocked with respect to any further movement due to its multiple deflection in the actuating direction as a result of the blocking element coming to bear against the transmission element. A particularly secure arrangement is achievable in that two blocking edges are provided in a manner spaced apart in the axial direction of movement of the transmission element, such as a Bowden cable.

Side impact beams generally are arranged between the door outer lining and the door inner lining in the cavities of the doors and act in a stabilizing manner in the event of a crash. An intrusion element can be arranged on the side impact beam to trigger the pivoting movement of the blocking element on the locking element in the event of a crash. The intrusion element interacts with the blocking element and pivots the blocking element into a blocking position of the transmission element.

An exemplary embodiment of the subject matter of the invention is illustrated in the drawings. The features of the subject matter of the invention are described in more detail in the following text by way of this exemplary embodiment.

DETAILED DESCRIPTION OF THE PREFERRED EMBODIMENT

Figure 1:
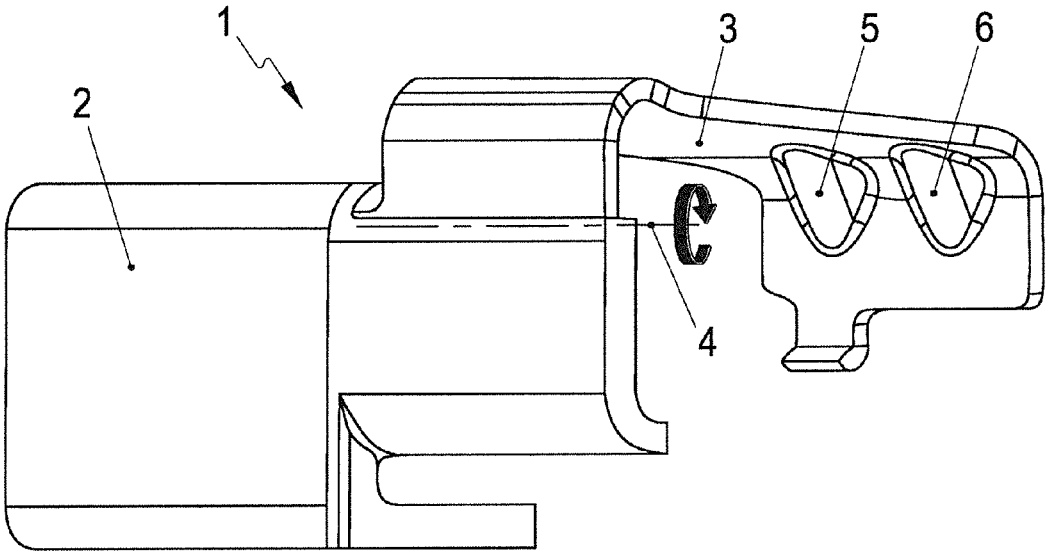
FIG. 1 is a perspective view of a locking element according to the invention, consisting of blocking element and guide part prior to deformation.
Figure 1A:
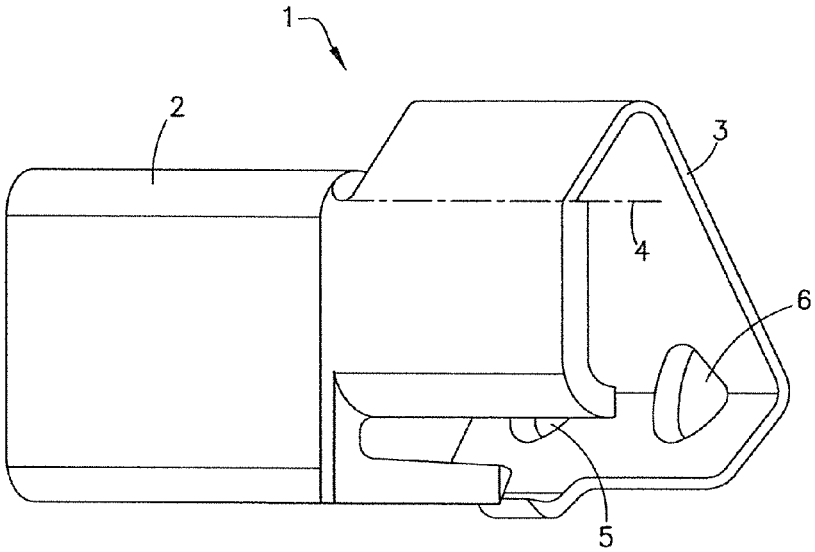
FIG. 1A is a similar perspective view of the locking element after a deformation caused by a side impact.
Figure 2:
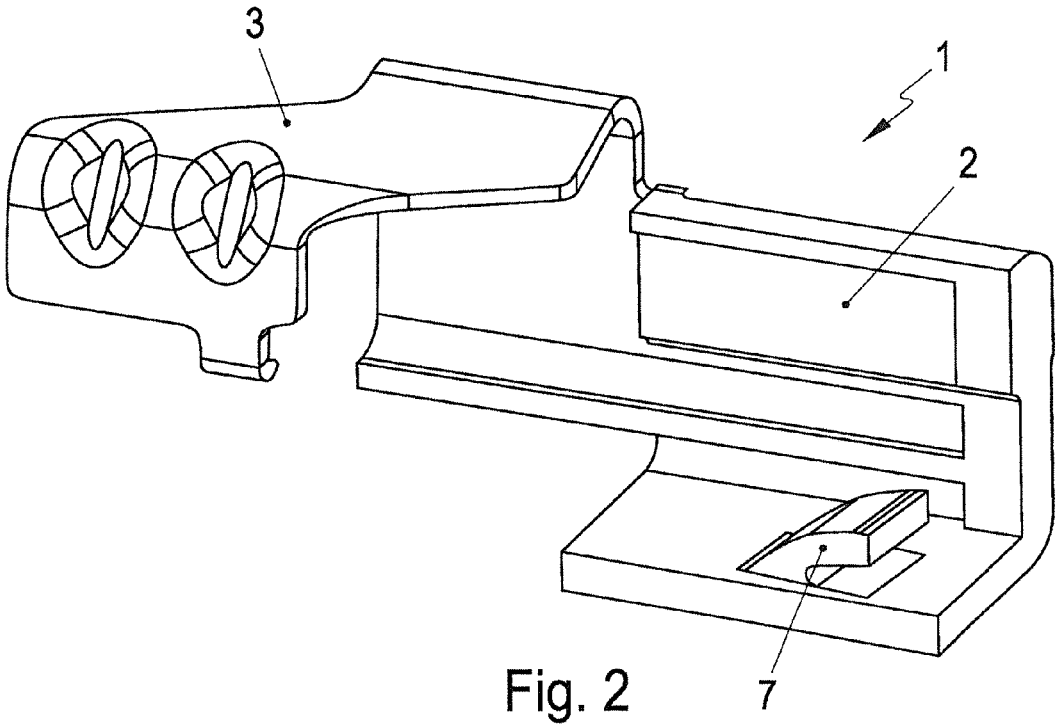
FIG. 2 shows the locking element according to FIG. 1 in an illustration rotated through about 180°.
Figure 3:
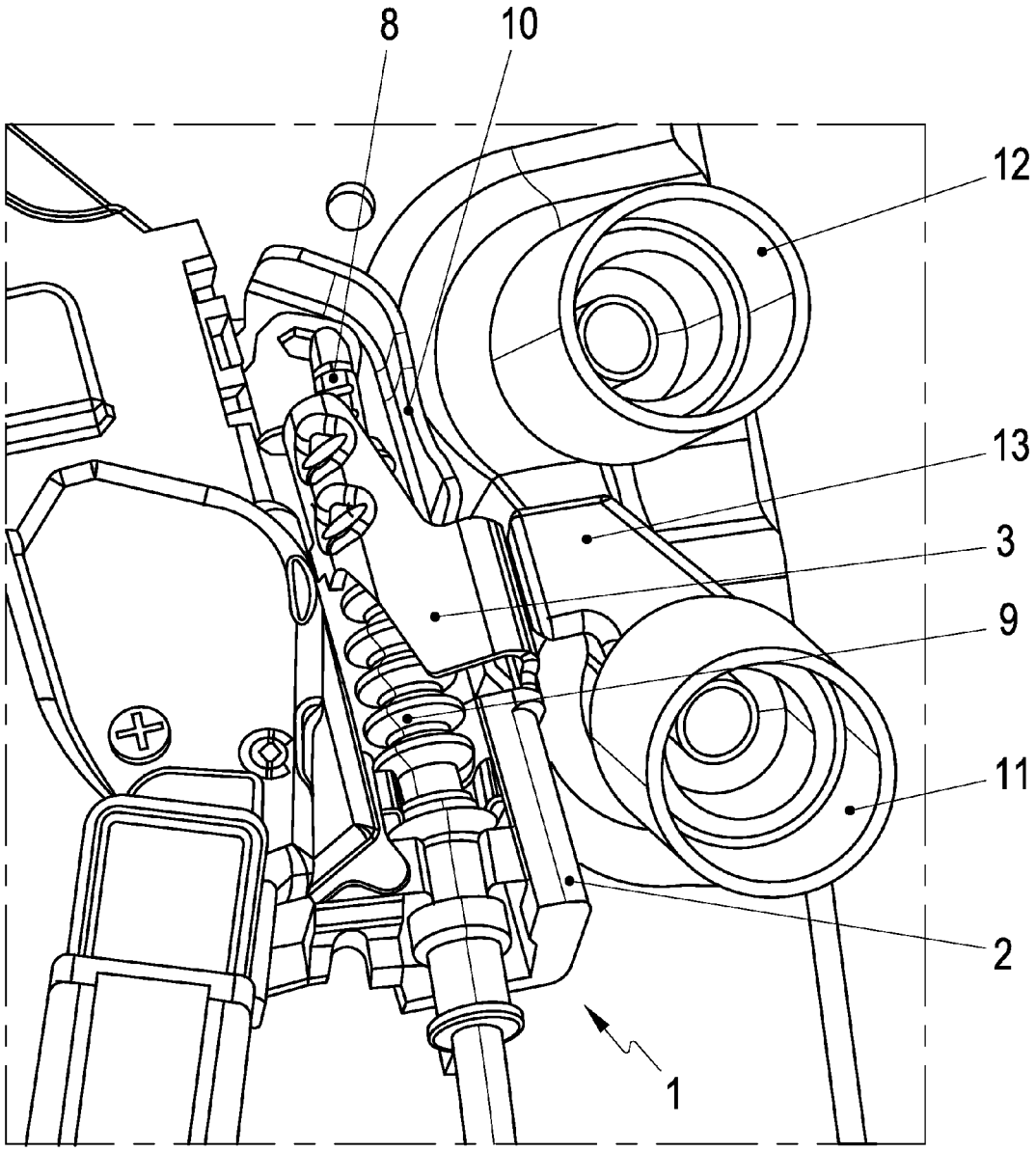
FIG. 3 shows the arrangement of the locking element according to the invention in the cavity of a vehicle door (partial detail).

FIG. 1 shows a locking element 1 that has a guide part 2 and a blocking element 3. The blocking element 3 is pivotable relative to the guide part 2 about a pivot axis 4. The pivotable disposition of the blocking element 3 on the guide part 2 can take place by clipping the blocking element 3 on the guide part 2, alternatively for example via a film hinge, in particular when the guide part 2 and blocking element 3 are produced from a suitable plastics material. Alternatively, the guide part 2 and the blocking element 3 may be formed of different thicknesses. For instance, as shown in FIGS. 2 and 3, the guide part 2 has a thickness greater than a thickness of blocking element 3 and the transition defines the pivot axis 4. Accordingly, the blocking element 3 is capable of pivoting in relation to the guide part 2.

The blocking element 3 has an approximately C-shape that engages partially or substantially around a transmission element (not illustrated in FIGS. 1 and 2), for example a Bowden cable, arranged in the door cavity.

On its inner C-side, the blocking element 3 has blocking edges 5 and 6 that project toward the transmission element (e.g. Bowden cable). The blocking edges 5, 6 have a double function. First, they stiffen the blocking element and second, as a result of the deflection of the transmission element (e. g. Bowden cable) that they bring about, absolutely secure clamping and thus blocking of the transmission element is effected.

FIG. 2 shows the locking element 1 in a depiction rotated through about 180° compared with the illustration in FIG. 1.

FIG. 3 shows the locking element 1 installed in the cavity of a vehicle door. The guide part 2 is fixed to parts of the door structure, for example via one or more clamping parts 7 (see FIG. 2), so that the blocking element 3 engages around or accommodates the transmission element 8 by way of its C-shaped inner side. If the transmission element 8, generally a Bowden cable, is sheathed with a bellows 9, the bellows 9 also is accommodated entirely or partially in the C-shaped interior of the blocking element 3.

In the event of a crash—for example a side impact—the door outer lining will deform, and the blocking element 3 will pivot radially about its pivot axis 4 in the direction of the transmission element 8, specifically so far that the transmission element 8 is secured in a jammed and thus immovable manner against a part of the door structure, such as the crash plate 10.

As described with reference to FIG. 1, this clamping effect can be reinforced by the arrangement of at least one blocking edge and the deflection, brought about thereby, of the Bowden cable 8 out of its direction of movement.

FIG. 3 shows side impact beams 11 and 12 that are arranged in the door cavity for stiffening the door construction in the event of a crash. An intrusion element 13 is arranged on the side impact beam 11, 12 or on the supporting construction thereof in the door structure. The intrusion element 13 pivots the blocking element 3 radially in the direction of the transmission element 8 (Bowden cable) as far as the blocking abutment thereof, for example against the crash plate 10, in the event of a crash when the door outer lining is displaced and, as a result, the side impact beams 11 and 12 are displaced/deformed in the direction of the door inner lining.

It is readily understandable for a person skilled in the art that there are a multiplicity of possible embodiments for the construction of the locking element 1, the guide part 2 and the blocking element 3 on the basis of the teaching of the invention.

What is claimed is:

1. A door structure for vehicles, comprising:

a door outer lining;

a door inner lining spaced inwardly from the door outer lining;

a locking/closing mechanism, the locking/closing mechanism being connected to a door release via at least one transmission element between the door outer lining and the door inner lining, the at least one transmission element extending axially in a first direction; and a locking element mounted adjacent to the at least one transmission element, the locking element having a guide part extending substantially parallel to the at least one transmission element and secured to the door structure, the guide part having opposite inner and outer guide part surfaces to define a guide part thickness between the inner and outer guide part surfaces and a C-shaped blocking element having opposite inner and outer blocking element surfaces to define a blocking element thickness between the inner and outer blocking element surfaces that is smaller than the guide part thickness, the C-shaped blocking element having a first panel joined to the guide part along a substantially linear deformation axis aligned substantially parallel to the transmission element, a second panel joined to an end of the first panel remote from the guide part and a third panel joined to an end of the second panel remote from the first panel, blocking edges projecting in from parts of the C-shaped blocking element where the third panel joins the second panel and being configured for reinforcing the third panel relative to the second panel, wherein in the event of a relative movement of the door outer lining toward the door inner lining, the C-shaped blocking element deforms about the deformation axis due to the different thicknesses where the first panel of the blocking element joins the guide part so that the blocking edges of the C-shaped blocking element engages an outer circumferential surface of the at least one transmission element to block the transmission element and inhibit operation of the transmission element.

2. The door structure of claim 1, further comprising side impact beams between the door outer lining and the door inner lining and having an intrusion element, via which the relative movement of the blocking element with respect to the guide part is triggered.

3. The door structure of claim 1, wherein the blocking edges are spaced apart from one another in a direction parallel to the transmission element.

4. The door structure of claim 1, wherein the transmission element is a Bowden cable.

* * * * *